US005363638A

United States Patent [19]

Spindler et al.

[11] Patent Number: 5,363,638

[45] Date of Patent: Nov. 15, 1994

[54] METHOD OF HANDLING A WOUND BOBBIN ON OPEN-END SPINNING MACHINES AND A DEVICE FOR CARRYING OUT THE METHOD

[75] Inventors: Zdeněk Špindler; František Buryšek; Vojtěch Novotny, all of Usti nad Orlici, Czechoslovakia

[73] Assignee: Elitex Ûstí Nad Orlicí, Czech Rep.

[21] Appl. No.: 947,702

[22] Filed: Sep. 18, 1992

[30] Foreign Application Priority Data

Sep. 23, 1991 [CS] Czechoslovakia ..... 2898-91

[51] Int. Cl.[5] ..... D01H 9/10

[52] U.S. Cl. ..... 57/270; 57/275; 57/281; 242/35.5 A

[58] Field of Search ..... 57/281, 400, 264, 268, 57/270, 275; 242/35.5 A

[56] References Cited

U.S. PATENT DOCUMENTS

| | | | |
|---|---|---|---|
| 4,582,270 | 4/1986 | Asai et al. | 242/35.5 A |
| 4,657,194 | 4/1987 | Wey et al. | 242/35.5 A |
| 4,895,313 | 1/1990 | Burysek et al. | 242/35.5 A |
| 5,165,615 | 11/1992 | Polnik | 57/270 X |

*Primary Examiner*—Joseph J. Hail, III

*Attorney, Agent, or Firm*—Notaro & Michalos

[57] ABSTRACT

A device for handling wound bobbins which are wound on a spinning machine includes an attending device which is moveable along the spinning machine from one wound bobbin to another. A tending device includes a lever which carries a gripping mechanism, for swinging the gripping mechanism toward and away from a wound bobbin. The gripping mechanism has gripping arms which can be spread for receiving a wound bobbin and then brought together for grasping a wound bobbin. The gripping mechanism can then rotate the arms through 180° and the lever can move the mechanism over a conveyor to deposit the wound bobbin onto the conveyor in the same orientation, whether the bobbin was removed from the spinning machine from one side or from an opposite side.

6 Claims, 6 Drawing Sheets

METHOD OF HANDLING A WOUND BOBBIN ON OPEN-END SPINNING MACHINES AND A DEVICE FOR CARRYING OUT THE METHOD

FIELD AND BACKGROUND OF THE INVENTION

The invention relates to a method of handling a wound bobbin on open-end spinning machines equipped with an attending device travelling along the machine and comprising a conveyor situated on its longitudinal axis for displacing the bobbins.

Open-end machines have been subjected to rapid development. They are automated to a considerable extent and known attending devices exist which permit machine operation without human intervention. Up to now, several basic methods for bobbin exchange with subsequent respinning-in have been used with some slight differences existing in the design of each of these methods. A common feature of all these methods is that the ready bobbin is transmitted by an automatic device from the machine arms to transport means, such as a conveyor.

As a rule, open-end spinning machines are double-sided and the bobbins produced on each of the two machine sides are oriented mutually exclusive of each other. A problem can be encountered when taking the bobbins from the machine for further processing of the yarn. This is due to the fact that the ready (wound) bobbin is fitted with a bunch, used for interconnecting the bobbins in subsequent operations and situated at one side of the tube so that its orientation become relevant. In order to accommodate this problem, most of the automatic machines are equipped with two continuous conveyors along the machine, each conveyor located at each side of the machine. The use of an automatic handling device situated at the machine end for taking the bobbins out of the machine and to give them the required orientation is also a known feature.

However, these solutions are unnecessarily expensive end complicated and are, thus economically disadvantageous and of limited reliability. Moreover, these measures would become superfluous if it were possible to take the bobbin out of the machine and situate it on the conveyor with uniform orientation irrespective of which side of the machine, the travelling attending device takes the bobbin from.

SUMMARY OF THE INVENTION

The drawbacks found in the known devices are eliminated by the method according to the present invention. The present invention ensures that a wound bobbin is gripped by a gripping mechanism of an attending device, according to which side of the machine the bobbin is located and, in turn, placed on the conveyor.

The principle of the device according to this invention consists in that the attending device comprises a machine side detecting device and a mechanism for transporting a wound bobbin on the conveyor through the use of a gripping and turning device for the wound cone.

BRIEF DESCRIPTION OF THE DRAWINGS

In order that the principle of the invention may be clearly understood, embodiments are shown in the accompanying drawings in which.

In the drawings.

DESCRIPTION OF THE PREFERRED EMBODIMENTS

Figure 1:
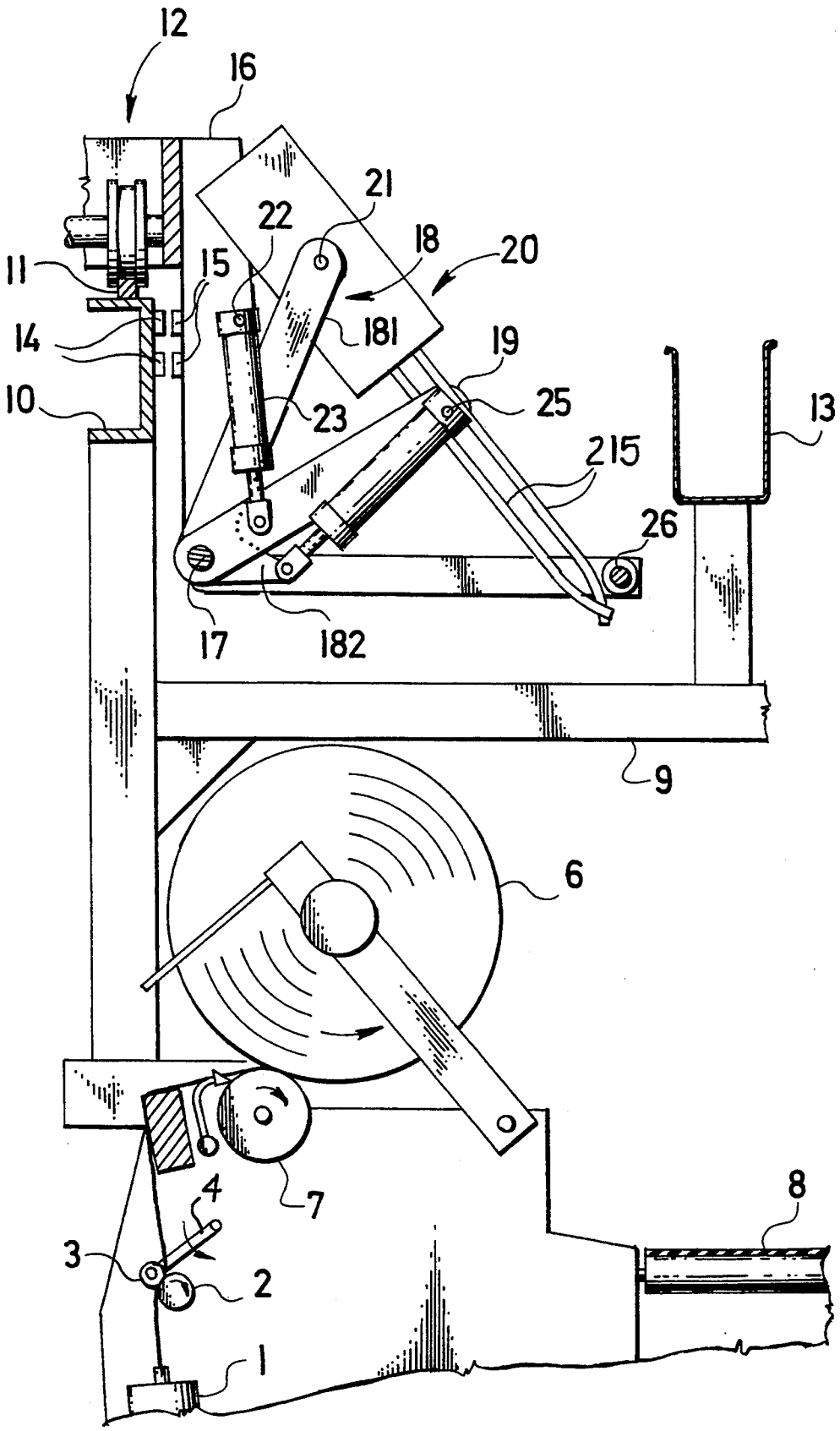
FIG. 1 is a side view of the present invention in an initial starting position.
Figure 2:
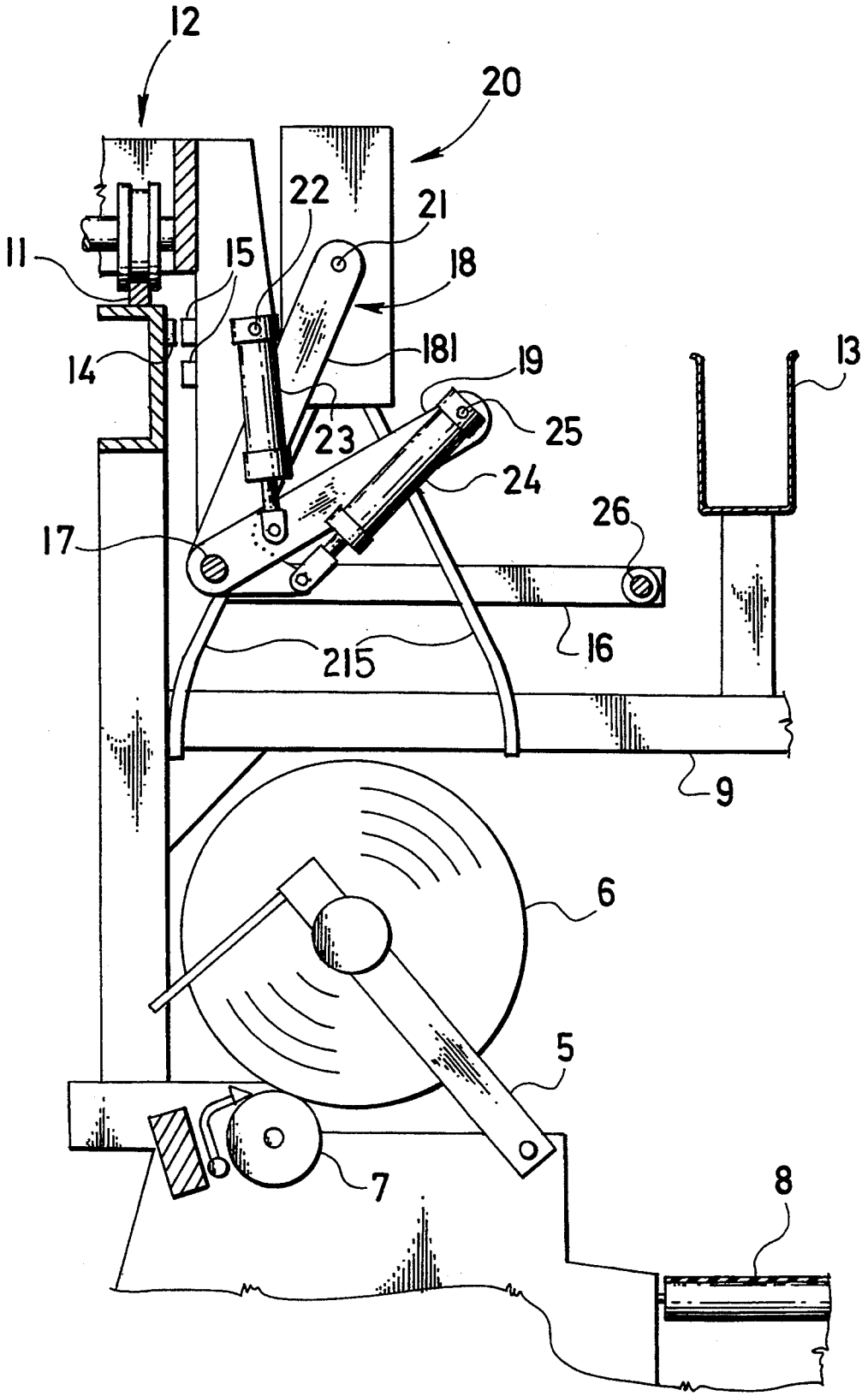
FIG. 2 is a side view of the device of FIG. 1 leaving the initial starting position.
Figure 3:
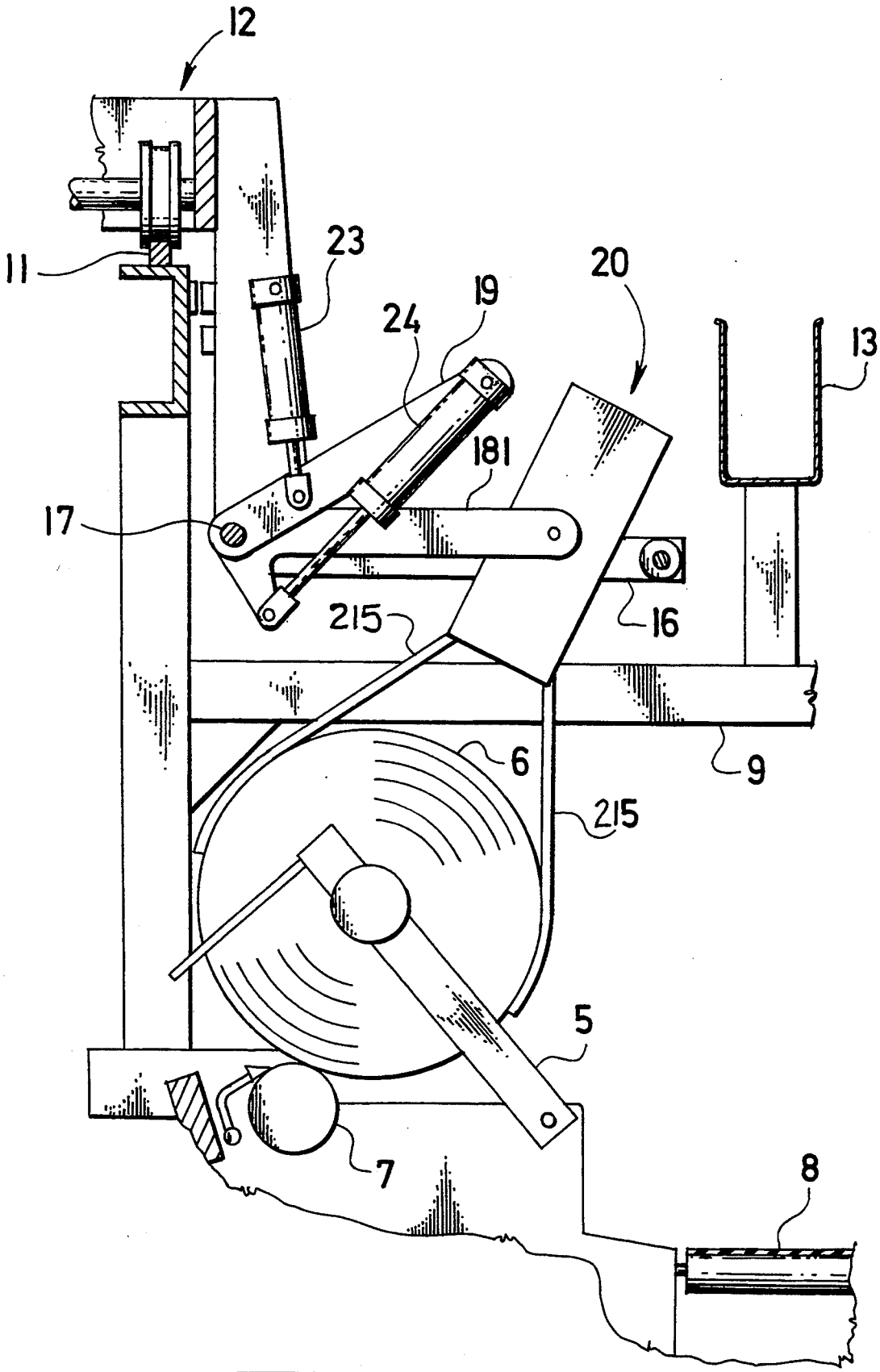
FIG. 3 is a side view of the device of FIG. 1, gripping the bobbin.
Figure 4:
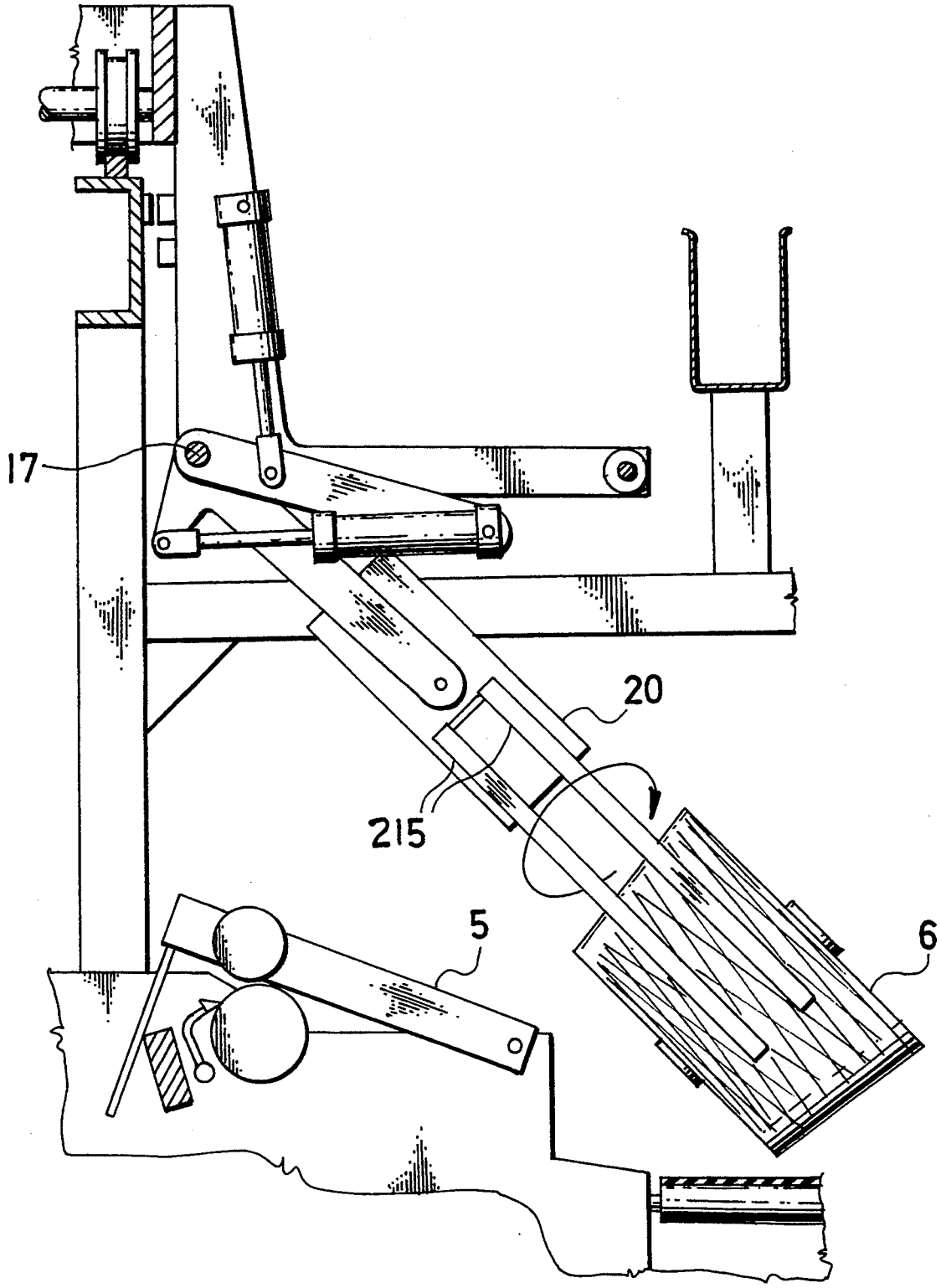
FIG. 4 is a side view of the device of FIG. 1 after the gripping of the bobbin and rotation of the bobbin.
Figure 5:
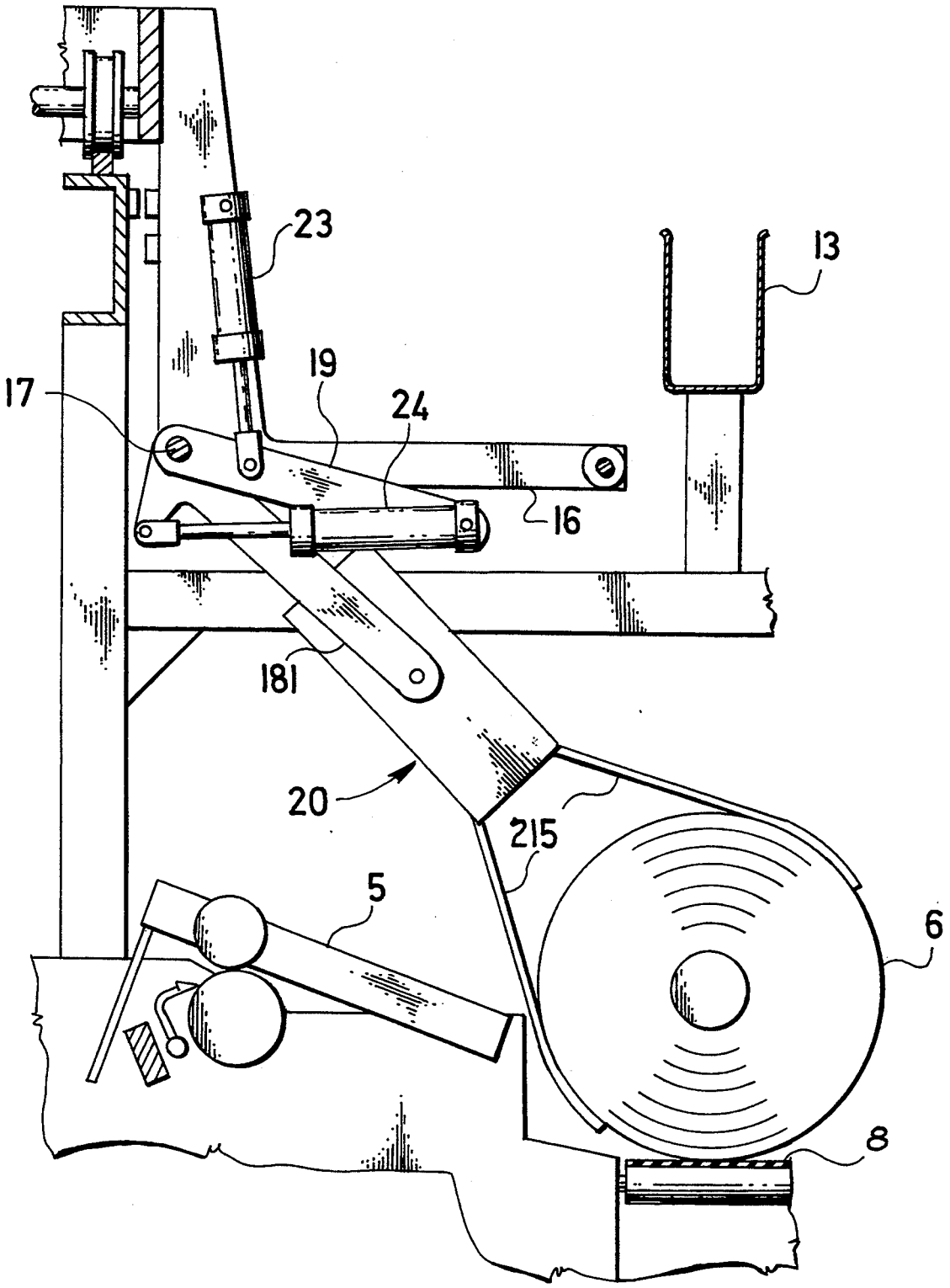
FIG. 5 is a side view of the device of FIG. 1 while placing the bobbin or cone on a conveyor.

The open-end spinning machine comprises a plurality of operation units arranged side by side, each of which is an independent unit producing yarn from a sliver and winding it on a cone.

FIGS. 1–6 illustrate the operation of the invention which comprises a spinning unit 1 having an outlet communicating with a yarn delivery device consisting of a delivery roller 2 and a pressure roller 3 rotatably mounted on a swinging lever 4 and in a known manner pushed into contact with the delivery roller 2. The yarn is led from the yarn delivery device to a winding device comprising a bobbin holder 5 wherein a bobbin 6 is wound and pushed into contact with a winding roller 7. Situated in the upper part of the machine and substantially along the longitudinal axis of the machine with respect to operating units of the machine, is a conveyor 8, driven in a known way and used to remove the wound bobbins 6 from the machine.

Frame 9 is provided on each side of the machine along the spinning units. A carrier beam 10 is fixed on each side of the machine, and a rail 11 for carrying an attending device 12 is provided on each beam 10. The rails 11 on the two machine sides can be interconnected at a machine end in an arch with only one attending device being provided for the whole machine, or there can be two straight rails 11 with two separate attending devices 12, one rail 11 for each machine side. A power cable, (not shown), is laid in a known way in a trough 13 fixed at the middle of the machine on the machine frame 9, for supplying power to the attending device 12 at a box which drives the outlet mechanisms and provides for a control system of the attending device.

In the embodiment, an ancillary bar 14 is fixed to the inner side of the carrier beam 10, at a different height on each side of the machine. In FIG. 1, the ancillary bar 14 for the side of the machine represented, is in solid lines. Opposite each ancillary bar 14, is provided at least one sensor 15 on the attending device 12 in order to identify the respective side of the machine.

The identification and indication of the machine side can also be carried out in another manner, for instance by an evaluation carried out by the control system of the attending device on the basis of counting the operating units of the machine, or by direct information based on the communication with an operating unit of the machine, etc.

Among other known devices for controlling the functions of the operating units and for the bobbin exchange, the attending device 12 is equipped with a device for taking out the wound bobbin and for orienting it before laying it on the conveyor 8 as shown by the respective operation stages in FIGS. 2 to 5.

A frame 16 of the attending device 12 carries an axis 17 on which are rotatably mounted a double-arm lever 18 and a one-armed lever 19. Rotatably mounted at the end of a first arm 181 of the double-arm lever 18 is a gripping and turning device 20, seated for instance in a bearing 21. Fixed to the frame 16 of the attending device 12 is a first pivot 22 carrying the bushing of a first pneumatic cylinder 23 whose piston rod is connected with the arm of the one-armed lever 19. At the end of the one-armed lever 19, a second pivot 25 is provided for being rotatably mounted by the bushing of a second pneumatic cylinder 24. A piston rod 124 of the second pneumatic cylinder 24 is rotatably connected with a second arm 182 of the double-arm lever 18. The above elements make up a device for moving the cone or bobbin 6 on the conveyor 8. On the inner end of the frame 16 of the attending device 12 is rotatably mounted a support roller 26.

Figure 6:
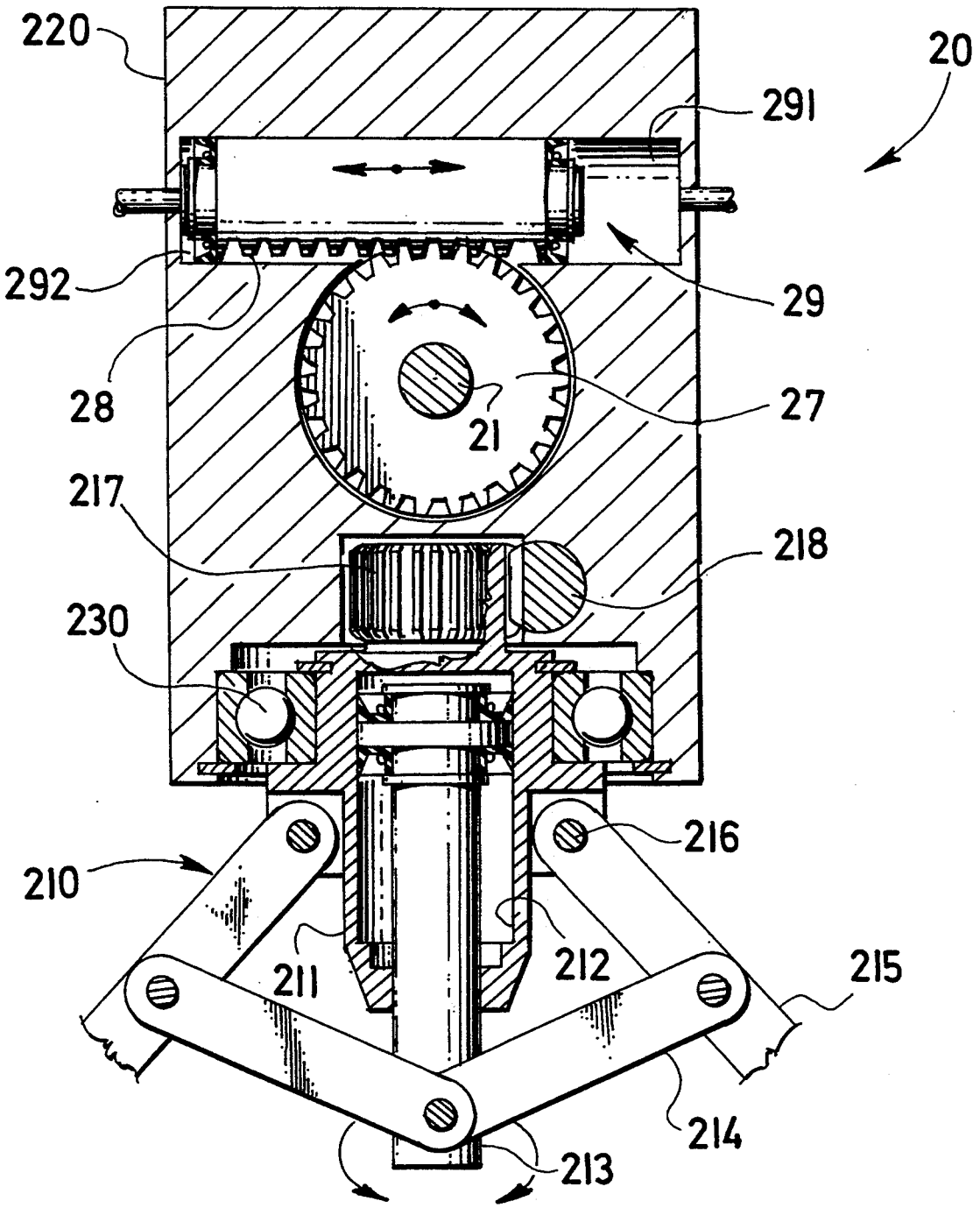
FIG. 6 is a cross-sectional view of the gripping and turning device according to the present invention.

The gripping end turning device 20, as shown schematically in FIG. 6, comprises a gripping device 210 whose body 211 is rotatably mounted in the body 220 of the gripping and turning device 20 by a bearing 230.

The gripping device 210 comprises a two-way pneumatic cylinder 212 on whose piston rod 213 there are rotatably mounted tie rods 214 whose ends are rotatably connected with gripping arms 215 of a wound cone 6 which, in their turn, are rotatably mounted on the body of the gripping device 210 on pivots 216. A part of the outer circumference of the gripping device 210 is made as a gearing 217 meshing with a rack 218 slidably mounted in the body 211 of the gripping and turning device 20 coupled with pneumatic cylinders serving as its drive (not shown).

The gripping and turning device 20 is rotatably mounted at the end of the first arm 181 of the double-arm lever 18 at the bearing 21. Fixed to the double-arm lever 18 is a gear wheel 27 meshing with an ancillary rack 28, made as a part of an ancillary two-way pneumatic cylinder 29 provided in the body 220 of the gripping and turning device 20 whose first chamber 291 and second chamber 292 are connected to a source of a pressure medium in a known manner.

We claim:

1. A device for handling wound bobbins processed on an open-end spinning machine having opposite sides and a rail fixed along each side, the wound bobbins being located at each side of the machine near the rail, the machine having a conveyor arranged along a longitudinal axis of the machine for receiving wound bobbins and moving the bobbins from the machine, the device comprising:

an attending device movably mounted to the rail for transversing the rail along each side of the machine, the attending device having gripping means for gripping the wound bobbins and placing the wound bobbins on the conveyor, the attending device having control means for detecting a wound bobbin located at a side of the machine and for directing movement of the attending device along the rail to the location of the wound bobbin, the control means being for directing the gripping of the wound bobbin and placement of the wound bobbin on the conveyor by the gripping means;

the attending device including lever means connected to the gripping means for moving the gripping means toward and away from a wound bobbin when the attending device is moved by the control means to a location of a wound bobbin along a side of the machine, the lever means also moving the gripping means from the side of the machine to the conveyor for depositing the wound bobbin on the conveyor; and the gripping means including a body pivotally mounted to the lever means for pivotal movement about an axis extending in a first direction and a gripping device rotatably mounted to the body for rotation about an axis extending in a second direction which is perpendicular to the first direction, the gripping device gripping the wound body from one side of the machine and thereafter rotating the wound bobbin from the one side of the machine through 180° so that all wound bobbins on the conveyor from one side of the machine can be rotated and all wound bobbins from an opposite side of the machine are not rotated, so that all wound bobbins on the conveyor face in the same direction.

2. The device according to claim 1, wherein the control means includes a sensor for detecting a wound bobbin located at a side of the machine.

3. The device according to claim 1, wherein the attending device includes a frame, the lever means comprises a double-arm lever pivotally mounted to the frame and rotatably mounted to the body for pivoting the body about the axis extending in the first direction, and a one-armed lever rotatably mounted to the attending device, the one-armed lever having a first pneumatic cylinder connected to the attending device and to the one-armed lever, the first pneumatic cylinder having a rod, the rod having one end connected to the one-arm lever and an opposite end contained within the first pneumatic cylinder, the rod being extendable into and out of the first pneumatic cylinder, the one-armed lever having a second pneumatic cylinder connected to the double-armed lever and to the one-armed lever, the second pneumatic cylinder having a second rod, the second rod having one end connected to the double-arm lever and an opposite end contained within the second pneumatic cylinder, the second rod being extendable into and out of the second pneumatic cylinder, the first and second pneumatic cylinders operating to move the body of the gripping means toward the location of a wound bobbin on the machine and from the location to the conveyor.

4. The device according to claim 3, wherein the gripping device includes a pair of gripping arms pivotally connected at one end to the body of the gripping means, the opposite end of each arm being for grasping a wound bobbin.

5. The device according to claim 4, wherein the gripping device further includes a two-way pneumatic cylinder fixed to the body of the gripping means having a piston rod slidably movable within the cylinder, the piston rod being extendable into and out of the cylinder, the piston rod having an outer section located outside of the cylinder and having a pair of tie rods rotatably mounted to the outer section, each tie rod being rotatably mounted to the outer section at one end and rotatably mounted to the gripping arms at an opposite end of each tie rod.

6. The device according to claim 3, wherein the gripping means further includes an ancillary two-way pneumatic cylinder fixed within the body, the cylinder housing a piston having a rack, the piston movable within the cylinder, the rack meshing with a gear wheel, the gear wheel rotatably movable around a bearing fixed to the body, the bearing securing the double-arm lever to the gripping means.

* * * * *